US005280235A

United States Patent [19]

Neale et al.

[11] Patent Number: 5,280,235

[45] Date of Patent: Jan. 18, 1994

[54] FIXED VOLTAGE VIRTUAL GROUND GENERATOR FOR SINGLE SUPPLY ANALOG SYSTEMS

[75] Inventors: Todd M. Neale, Carrollton; Brad P. Whitney, Garland; Mark E. Granahan, Dallas, all of Tex.

[73] Assignee: Texas Instruments Incorporated, Dallas, Tex.

[21] Appl. No.: 856,860

[22] Filed: Mar. 24, 1992

Related U.S. Application Data

[63] Continuation of Ser. No. 758,669, Sep. 12, 1991, abandoned.

[51] Int. Cl.[5] ..... G05F 3/16

[52] U.S. Cl. ..... 323/314; 323/907

[58] Field of Search ..... 323/311, 312, 313, 314, 323/907

[56] References Cited

U.S. PATENT DOCUMENTS

| | | | |
|---|---|---|---|
| Re. 30,586 | 4/1981 | Brokaw | 323/314 |
| 3,634,751 | 1/1972 | Miller | 323/313 |
| 4,055,777 | 10/1977 | Black | 307/265 |
| 4,058,760 | 11/1977 | Ahmed | 323/314 |
| 4,087,758 | 5/1978 | Hareyama | 330/261 |
| 4,100,437 | 7/1978 | Hoff | 323/314 |
| 4,250,445 | 2/1981 | Brokaw | 323/313 |
| 4,260,946 | 4/1981 | Wheatley | 323/314 |
| 4,313,083 | 1/1982 | Gilbert et al. | 323/313 |
| 4,348,633 | 9/1982 | Davis | 323/314 |
| 4,364,006 | 12/1982 | Makabe et al. | 323/353 |
| 4,375,595 | 3/1983 | Ulmer et al. | 323/314 |
| 4,412,241 | 10/1983 | Nelson | 323/354 |
| 4,525,663 | 6/1985 | Henry | 323/313 |
| 4,665,356 | 5/1987 | Pease | 323/907 |
| 4,713,599 | 12/1987 | Davis | 323/354 |
| 4,713,602 | 12/1987 | Ueda | 323/354 |
| 4,795,961 | 1/1989 | Neidorff | 323/907 |
| 4,827,205 | 5/1989 | Hafner et al. | 323/314 |
| 4,896,094 | 1/1990 | Greaves et al. | 323/314 |
| 4,987,379 | 1/1991 | Hughes | 323/313 |
| 5,030,848 | 7/1991 | Wyatt | 323/313 |
| 5,041,795 | 8/1991 | Bowers | 307/494 |
| 5,047,707 | 9/1991 | Dixon et al. | 323/314 |
| 5,051,686 | 9/1991 | Schaffer | 323/313 |

*Primary Examiner*—J. L. Sterrett

*Attorney, Agent, or Firm*—Mark E. Courtney; Richard L. Donaldson

[57] ABSTRACT

A method and apparatus for a circuit physically realizing a virtual ground function and having improved accuracy and stability is described. A stable bias current source is coupled to a bandgap reference generator and resistances to produce a virtual ground voltage of a precise value, this voltage is then coupled to an operational amplifier configured in a unity gain configuration. The circuit thus created offers numerous advantages over the virtual ground circuits in use in the prior art. An integrated circuit implementing this circuit is described, and alternative packaging embodiments are disclosed. Other embodiments are also disclosed.

29 Claims, 6 Drawing Sheets

FIXED VOLTAGE VIRTUAL GROUND GENERATOR FOR SINGLE SUPPLY ANALOG SYSTEMS

This application is a continuation of application Ser. No. 07/758,669, filed Sep. 12, 1991, now abandoned.

RELATED APPLICATIONS

This application is related to co-pending application for U.S. Letters Patent Ser. No. 758,039, filed Sep. 12, 1991, entitled "Rail Splitting Ground Generator for Single Supply System", incorporated herein by reference.

FIELD OF THE INVENTION

This invention generally relates to a method and apparatus for providing an improved stable and accurate virtual ground reference voltage for use in circuits wherein a single supply voltage is employed.

BACKGROUND OF THE INVENTION

Heretofore, in the field of single supply circuits in general, there have been several approaches to designing a virtual ground voltage reference which allow the circuit to accept as input a signal centered around ground, with positive and negative values at different times, and create an output which reflects the entire waveform without loss of data due to waveform clipping. To prevent the clipping of the input waveform a virtual ground is required to terminate the input voltage signal and the output load and thus translate the output so that it is centered around a reference voltage. Some typical approaches to designing a virtual ground voltage reference are to create voltage divider circuits using discrete components. These discrete solutions have several drawbacks which disadvantageously affect the circuits in which they are used, including poor load regulation, excessive power dissipation, large circuit board area requirements, and excessive numbers of component requirements. Accordingly, improvements which overcome any or all of these problems are presently desirable.

SUMMARY OF THE INVENTION

Generally, and in one form of the invention, a circuit is described which implements a virtual ground function, having several subcircuits which operate together to provide a virtual ground of half the voltage of the supply voltage. The circuit thus created has many advantages over the prior art solutions, including high current sinking and sourcing capability, highly accurate output voltage, outstanding load regulation, greatly reduced power dissipation, increased dynamic signal range, lower distortion and improved signal-to-noise characteristics, and improved accuracy.

A second embodiment is described wherein the circuit is integrated and packaged in a three terminal package. When this embodiment is employed in a typical system using a single supply voltage, the invention advantageously provides a saving in board area, a reduced component count and a reduced connection count, and provides excellent ease of use characteristics in a circuit board or other card or board environment.

A further embodiment is described wherein the circuit is packaged in an eight pin DIP.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 1A:
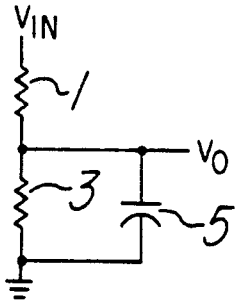
PRIOR ART FIG. 1a
FIG. 1 depicts four prior art virtual ground circuit solutions, in FIGS. 1A–1D.

The virtual ground circuit of the invention makes it possible to provide a highly accurate virtual ground with outstanding load regulation, low power supply requirements, and improved noise performance over the prior art solutions. By combining a bandgap voltage reference with a high performance op amp having particular characteristics, a virtual ground is produced which is typically 2.5 V, or ½ of the supply voltage in a typical 5 V system, although other voltages are easily produced. The circuit of the invention requires no additional biasing components or other connections to operate.

FIG. 1 depicts four prior art solutions to the problem. In FIG. 1A, a resistor voltage divider with a filter capacitor is used to divide the power supply voltage by 2. Resistor 1 and resistor 3 provide a standard voltage divider, with capacitor 5 providing a filter to reduce noise at the output $V_o$. The circuit of FIG. 1A is used in many prior art applications of a virtual ground. A second prior art alternative is shown in FIG. 1B, with resistor 9 and shunt regulator 11 providing the output voltage $V_o$. The circuit of FIG. 1B is also commonly used to provide a virtual ground in many circuits. These approaches both exhibit many disadvantages, for instance the voltage divider of FIG. 1A exhibits poor input regulation because as the supply voltage varies, the output voltage $V_o$ moves approximately 50% or, for example in a 5 volt system, 0.5 V/Volt. This leads to a reduction in the usable common-mode voltage range and output swing of the circuit using the virtual ground. Power dissipation is also higher than desirable, for a typical 1-K ohm resistor divider in a 5 V system, the power dissipation is 12.5 mW DC.

Figure 1B:
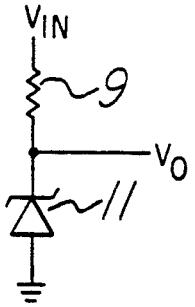
PRIOR ART FIG. 1b

FIG. 1B depicts the creation of the virtual ground using an active device, such as a voltage reference. Because all such voltage references are essentially power sources, the active element is designed to either source or sink current, but not both. In the configuration shown in FIG. 1B, the resistor 9 must provide current to the load and the shunt voltage reference 11.

Peak current demand will result in significant changes in the value at the $V_o$ terminal unless ample bias current is made available, which results in extra power dissipation.

Figure 1C:
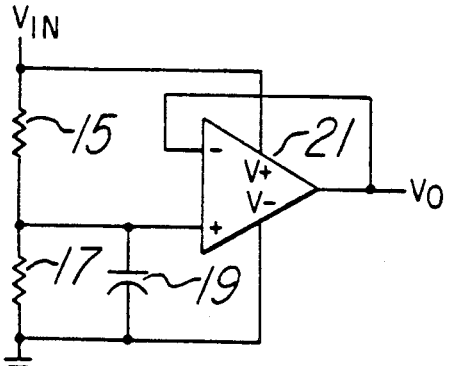
PRIOR ART FIG. 1c
Figure 1D:
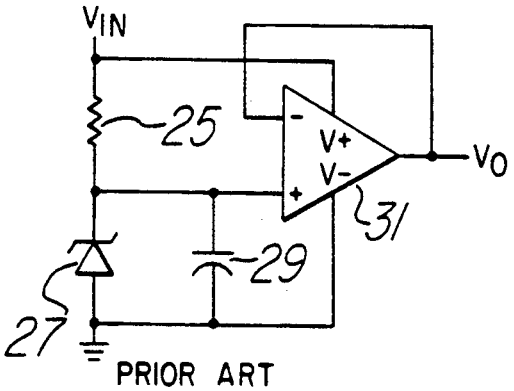
PRIOR ART FIG. 1d

FIGS. 1C and 1D depict improvements on the arrangements in FIGS. 1A and 1B, respectively, by adding a buffer to the basic virtual ground circuit. These approaches solve some of the problems, specifically the power dissipation problems. Also, input regulation due to the active reference and load regulation due to the buffer are significantly enhanced over all prior methods. The cost for these improvements is a significant increase in component count and board area. Further, the addition of the amplifier places an additional power demand on the power supply.

Figure 2:
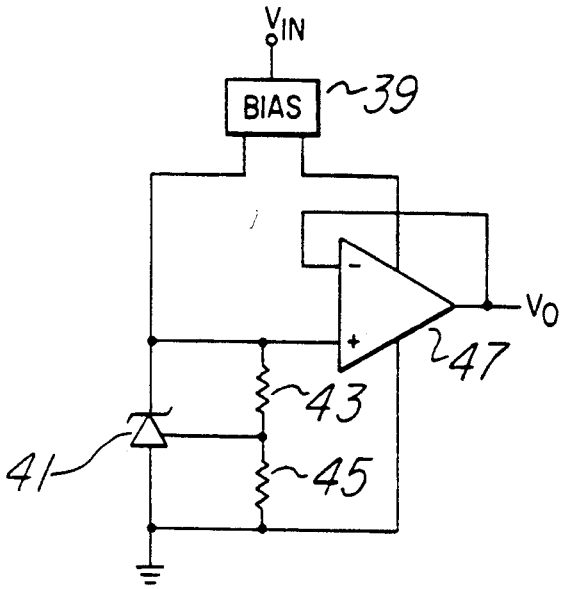
FIG. 2 is a block diagram of the virtual ground circuit of the invention.

FIG. 2 depicts a block diagram of the virtual ground circuit of the invention. Current source 39 is coupled to the voltage reference 41 and the resistor network comprised of resistors 43 and 45. Current source 39 is further coupled to the positive voltage supply input of amplifier 47. Amplifier 47 is coupled to the reference voltage and provides a buffer to the output $V_o$.

Figure 3:
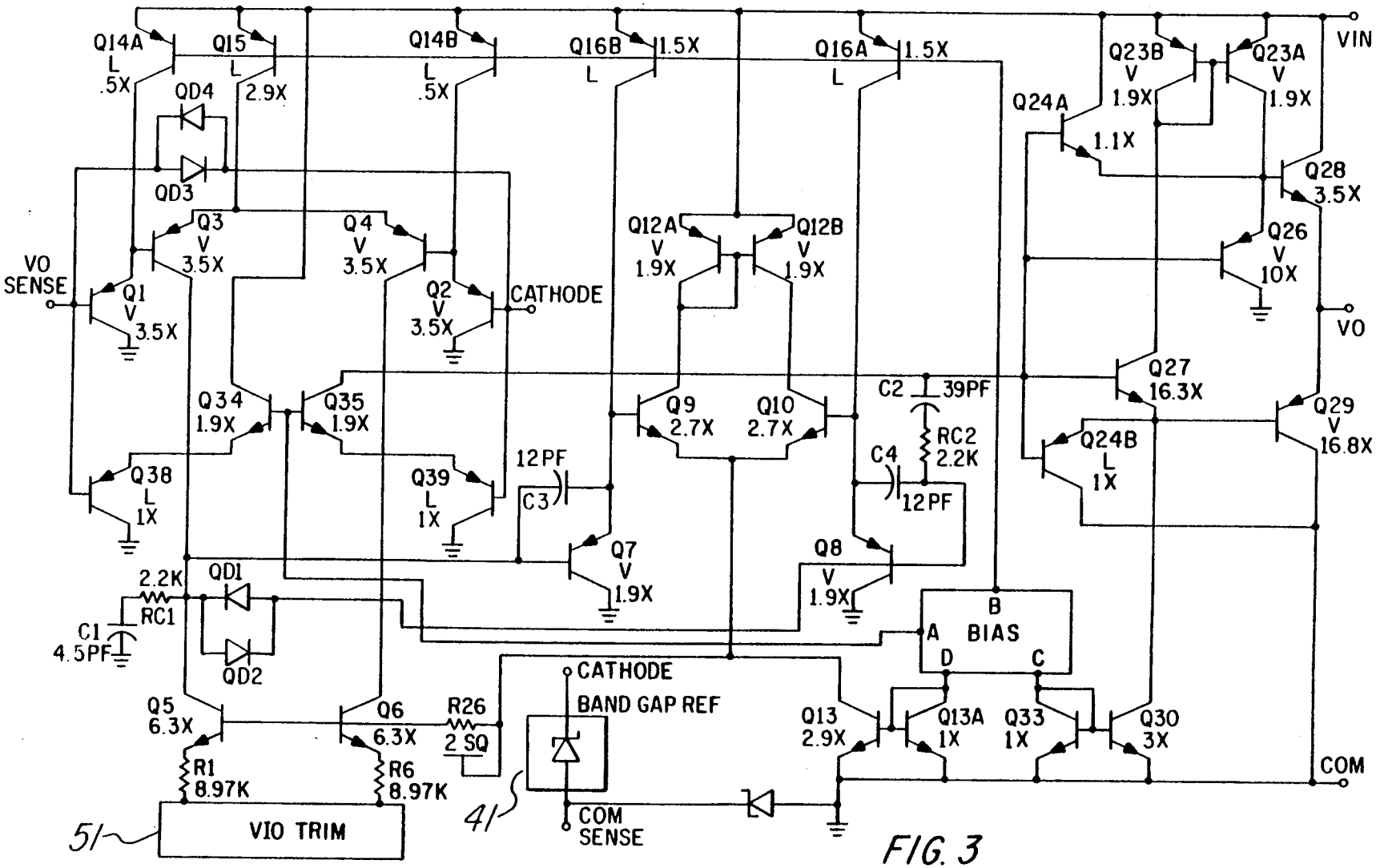
FIG. 3 is a schematic diagram of the virtual ground circuit.

FIG. 3 depicts a schematic diagram of the circuit of FIG. 2. The operational amplifier 47 from FIG. 2 is now shown in an exploded view, the shunt reference 41 is shown coupled to the operational amplifier, the bias circuit 39 is shown coupled to the operational amplifier and the bandgap reference, and the detail of the operational amplifier includes a trim circuit 51.

In operation, the bandgap reference 41 is used to develop a precision, temperature stable reference voltage. The op amp 47 is operated as a unity gain buffer and is connected to the bandgap reference. The output voltage of the op amp, $V_o$, is equal to the voltage reference produced by the bandgap reference 41 and resistors 43 and 45, and is the output of the virtual ground circuit. The op amp 47 is used to advantageously provide the high current sink and current source capability of the virtual ground circuit, which the bandgap reference 41 alone is incapable of doing. The op amp 47 is also used to lower the output impedance of the virtual ground circuit. The bias circuit 39 is used to develop a reference current which is than mirrored to the rest of the circuit and is used to develop the operating point for the circuit. The trim circuit 51 is used to eliminate an error term in the virtual ground output voltage. Each circuit block depicted in FIGS. 2 and 3 was chosen for its combination of performance, stability and low-power requirements.

The op amp 47 is designed for a combination of specific DC, AC and low-power characteristics. The most interesting characteristic of op amp 47 is its ability to source and sink large load currents with only a very small quiescent current drawn from the power supply. This capability is achieved using a boost circuit comprised of Q24A and Q24B in addition to the standard output stage consisting of Q23A, Q23B, and Q26–Q30. When the current load requirement at the output exceeds the ability of the standard output stage to source or sink current, the boost circuit turns on and allows the output to source or sink additional load current. The boost circuit senses the output voltage; when the load current exceeds the capability of the standard output stage, the output voltage will move away from the desired value. The boost circuit to turns on and moves the output voltage back to the desired value while increasing the current source and sink capability. The boost circuit is turned on only when needed to keep the quiescent supply current low.

The op amp 47 was also chosen for its high DC gain. When an op amp is used in a closed-loop unity gain configuration, the output impedance is reduced from its open-loop value by the open loop gain of the op amp, $A_{v\ open\ loop}$; thus $$R_{out:closedloop} = \frac{R_{out:openloop}}{1 + \beta A_{vopenloop}}$$

where $\beta = 1$.

Output impedance of the circuit is important because as load current is sourced or sunk by the virtual ground circuit, the output voltage will move away from the desired value. The higher the output impedance, the farther away the output voltage will move. Thus, reducing output impedance is a critical factor in reducing the output voltage error term due to load current. Low output impedance is achieved by using a high gain op amp in a unity gain configuration. This ability of a circuit to maintain a constant output voltage while load current is varied is known as load rejection.

High gain is achieved in op amp 47 by using many gain stages. However, using many gain stages usually degrades the frequency (AC) performance. The AC performance depends on the small-signal bandwidth of the op amp design and the speed of the process. By using the process described in U.S. Pat. No. 4,939,099; entitled "Process for Fabricating Isolated Bipolar and JFET Transistors", and herein incorporated by reference, the designer may achieve many advantages. The process allows the op amp 47 to use very low values of current which contributes to the high gain and the low power consumption of the virtual ground circuit thus created. The process retains its speed at low supply currents giving a high small-signal bandwidth, and, as a consequence, a high full power bandwidth. The full power bandwidth relates directly the virtual ground AC performance versus the frequency of the load current variation. As the frequency of the load current variation is increased beyond the full power bandwidth, the virtual grounds becomes less and less able to maintain the desired output voltage. High full power bandwidth enables the virtual ground circuit of FIGS. 2 and 3 to handle quickly changing load current without moving the output voltage $V_o$ from its desired value. Of course, any other processes may be used, but some of the advantageous features described here may not be achieved or reduced as a result.

Figure 4A:
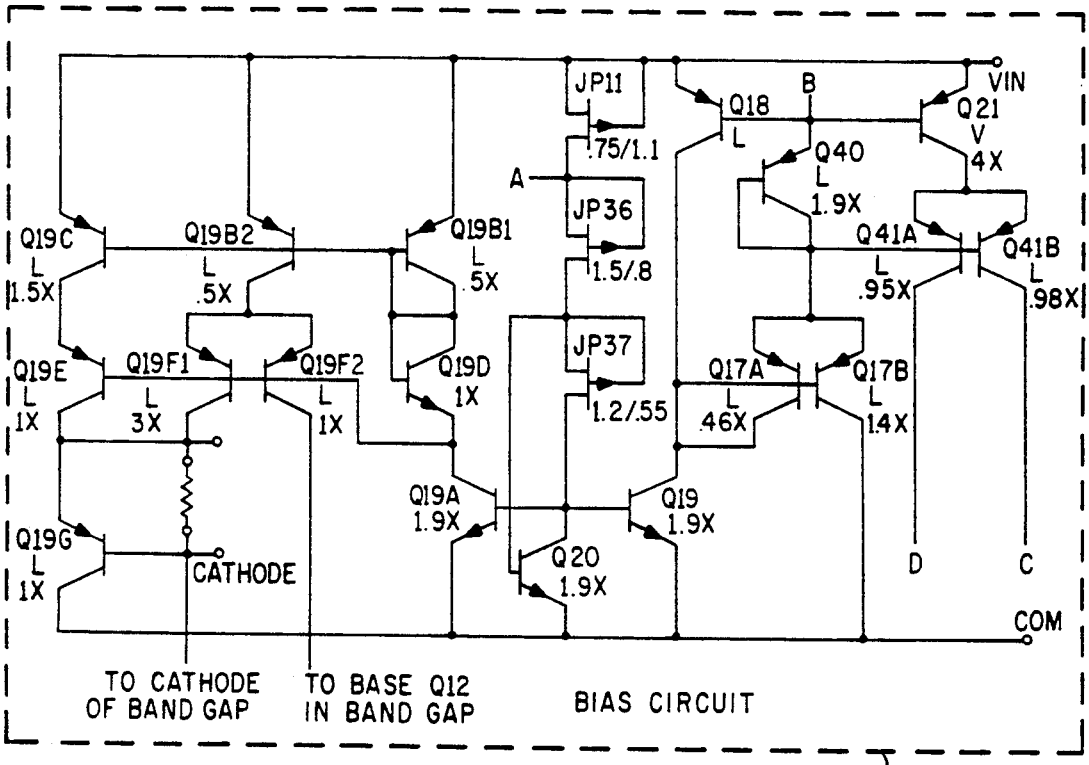
FIGS. 4*a* and 4*b* are schematic diagrams of the bias and trim circuits of the virtual ground circuit shown in FIG. 2.
Figure 4B:
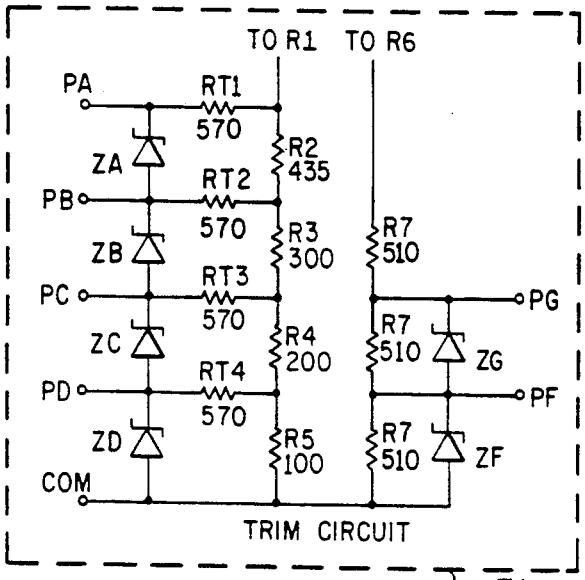

FIG. 4 depicts the schematic diagrams of the bias circuit 39 in FIG. 4A, and the trim circuit 51 in FIG. 4B.

FIG. 4A depicts the bias circuit. The core of the bias circuit is that which is described in U.S. Pat. No. 4,975,632, "Stable Bias Current Source", herein incorporated by reference. In FIG. 4A., device JP11 is a gate-source connected JFET tied to the most positive supply rail. This device is equivalent to device JP1 on the above mentioned patent. Device JP37, another gate-source connected JFET, is equivalent to JP2 in the patent. Device Q19, an NPN bipolar transistor, is equivalent to Q3 and, device Q20, and NPN bipolar transistor, is equivalent to Q4 in the patent. These devices comprise the core of the temperature stable bias circuit and provide the known reference current for the rest of the virtual ground circuit depicted in FIGS. 2 and 3.

The remainder of the active devices shown on the bias circuit schematic FIG. 4A (JP36, Q17, Q18, Q19, Q21, Q40 and Q41) are used to ratio and mirror the reference current and to provide additional stability over supply variation.

The advantages of this temperature stable bias circuit are many fold. The primary advantage is the improved accuracy of the reference voltage developed by the bandgap reference 41. For the bandgap reference 41 to operate, it must be supplied with a minimum amount of current. It will operate over a wide range of currents, tens of microamps up to several milliamps. However, as this current changes, so does the reference voltage supplied by bandgap reference circuit 41. This can be though of as an error term in the overall accuracy of the virtual ground circuit. As load current is sunk or sourced by the virtual ground circuit, power dissipation and, as a consequence, die temperature changes significantly. Since the bias source 39 is temperature stable, the current into the bandgap reference 41 does not change and therefore the reference voltage provided does not change. Thus, the error term caused by changing temperature on the die due to power dissipation or changes in the ambient temperature is virtually eliminated.

Another advantage of bias circuit 39 relates to the current that flows from the op amp 47 terminal labeled CATHODE (base of transistor Q2 on FIG. 3). This current also flows into the bandgap reference 41. For the above mentioned reasons, this current can cause a error term in the reference voltage. The temperature stable bias source 39 allows this op amp terminal current to be more stable over temperature than otherwise would be possible and thus reduces the error term due to this terminal current.

The second major advantage of the temperature stable bias source 39 is that it allows the op amp 47 to keep a fairly constant full power bandwidth over temperature. As discussed in above in reference to the operation of the op amp 47, a high full power bandwidth is desirable. Since the temperature stable bias source 39 allows the op amp 47 to maintain a constant small-signal bandwidth over temperature, the user can expect the virtual ground circuit to have the same frequency (AC) performance over temperature as it exhibits at room temperature. As stated above, additional components were added, using standard techniques, that increase the stability of the reference current over supply variation. As the supply is varied, the reference current remains constant. Thus the accuracy and the AC performance of the virtual ground circuit remains constant as the supply voltage is varied. No matter what temperature, power dissipation or supply voltage the user operates the circuit at (within the recommended operating range), accuracy, and AC parameters that vary due to bias current stability, are held constant. This is a significant advantage over the prior art.

FIG. 4B depicts the schematic diagram of the VIO TRIM circuit 51. This circuit is used to minimize another output voltage error term generated by the op amp 47. The offset voltage of the op amp adds (or subtracts) from the voltage reference developed by the bandgap reference 41. Thus, the output voltage of the virtual ground does not equal the reference voltage generated by the bandgap reference 41. The trim circuit 51 allows the offset voltage of the op amp 47 to be trimmed to a very low value so that the output voltage $V_o$ is as close as possible to the reference voltage generated by the bandgap reference 41.

Figure 5:
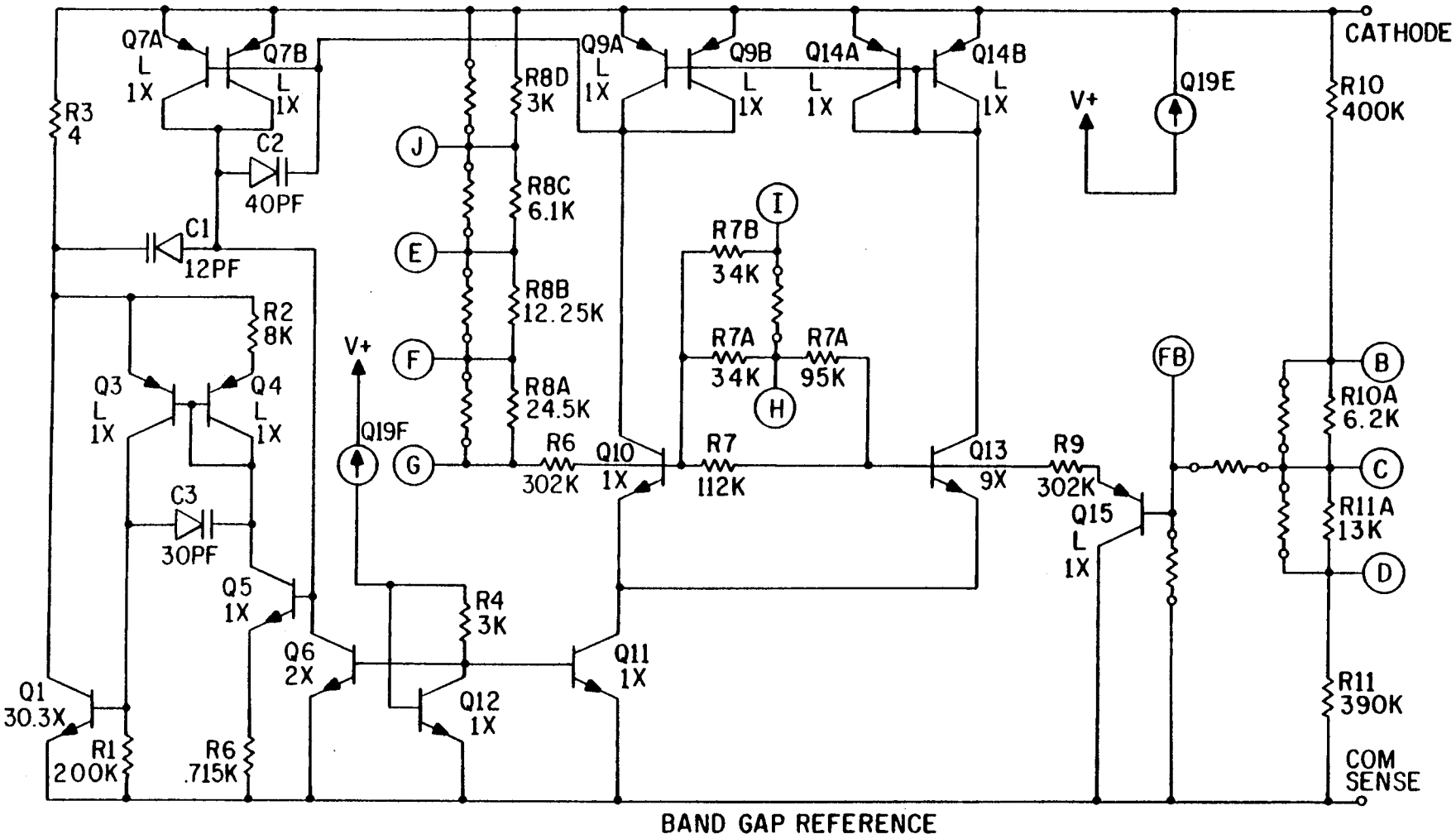
FIG. 5 is a schematic diagram of the bandgap reference circuit used in the virtual ground circuit shown in FIG. 2.

FIG. 5 depicts the schematic or exploded view of the bandgap reference circuit 41. Bandgap reference 41 is designed for temperature stability. The reference voltage developed by the bandgap reference 41 is relatively constant over changes in temperature. These changes in temperature can be caused by changes in the ambient temperature and/or changes in the die temperature due to increased power dissipation caused by changes in the virtual ground load current. Bandgap reference 41 is also designed to meet low-power requirements; it requires only a few tens of microamps to operate. Three major error terms are introduced into the reference voltage, and thus the virtual ground output voltage, by the bandgap circuit 41. The first is the reference voltage change due to temperature. This can be minimized by selecting the proper bandgap voltage. This is achieved by trimming the bandgap voltage with resistors R8A–D and R7A–C and fuses E–J as labeled in FIG. 5. The second error contributed by the bandgap reference is the absolute value of the reference voltage. This is set by gaining up the bandgap voltage with resistors R10 and R11, which are equivalent to resistors 43 and 45 in FIG. 2. This reference voltage can be adjusted by using resistors R10A and R11A and fuses B and D. The third error term is due to the changing current that flows into the bandgap 41 from bias circuit 39 and is minimized as discussed above.

The virtual ground circuit depicted in FIGS. 2–5 provides a stable, accurate, fixed voltage output based on the voltage reference provided by the bandgap reference circuit. Typical applications call for a reference voltage of 50% of the supply voltage, which is typically 5 V, so that a 2.5 V virtual ground is required. The circuit in FIG. 2 has been produced in a 2.5 V output version and has been found to provide a well regulated reference voltage with plus or minus 20 mA of output current drive (source or sink) over a supply voltage range of 4–40 V.

Figure 6:
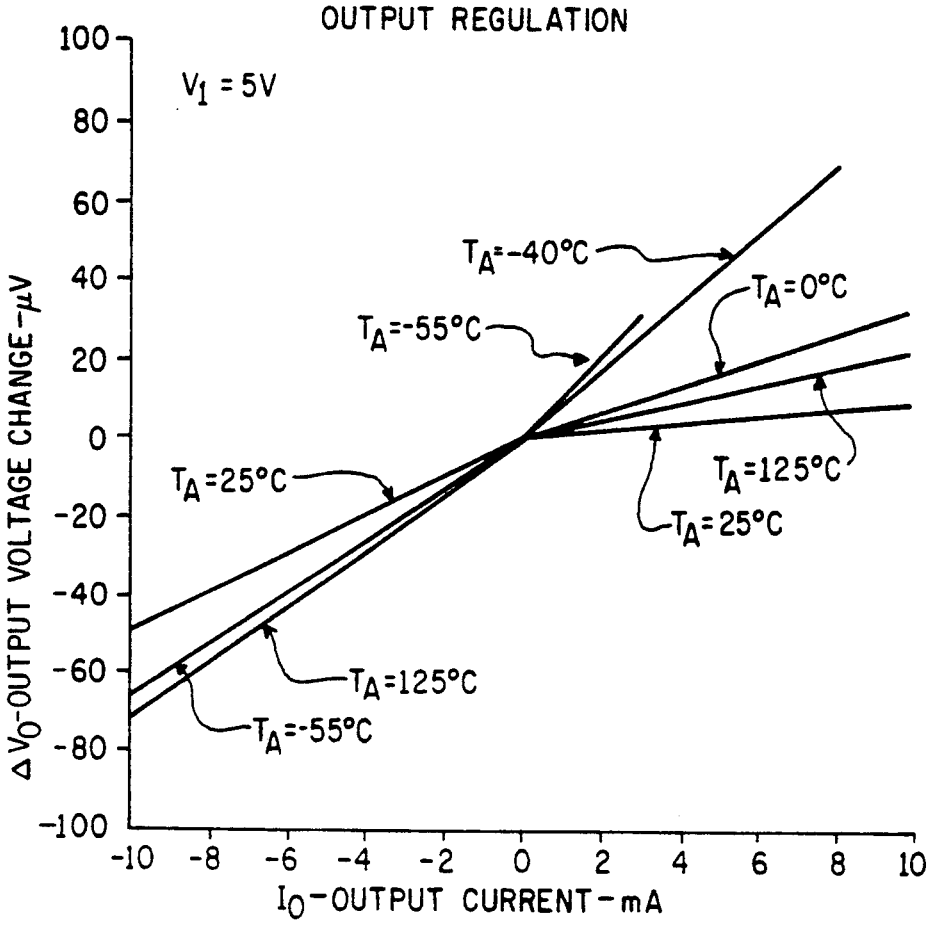
FIG. 6 depicts the output regulation performance of the circuit of FIGS. 2–5 over a range of temperatures.

FIG. 6 depicts the output regulation performance of the circuit depicted in FIGS. 2–5 over a variety of temperature conditions.

Figure 7:
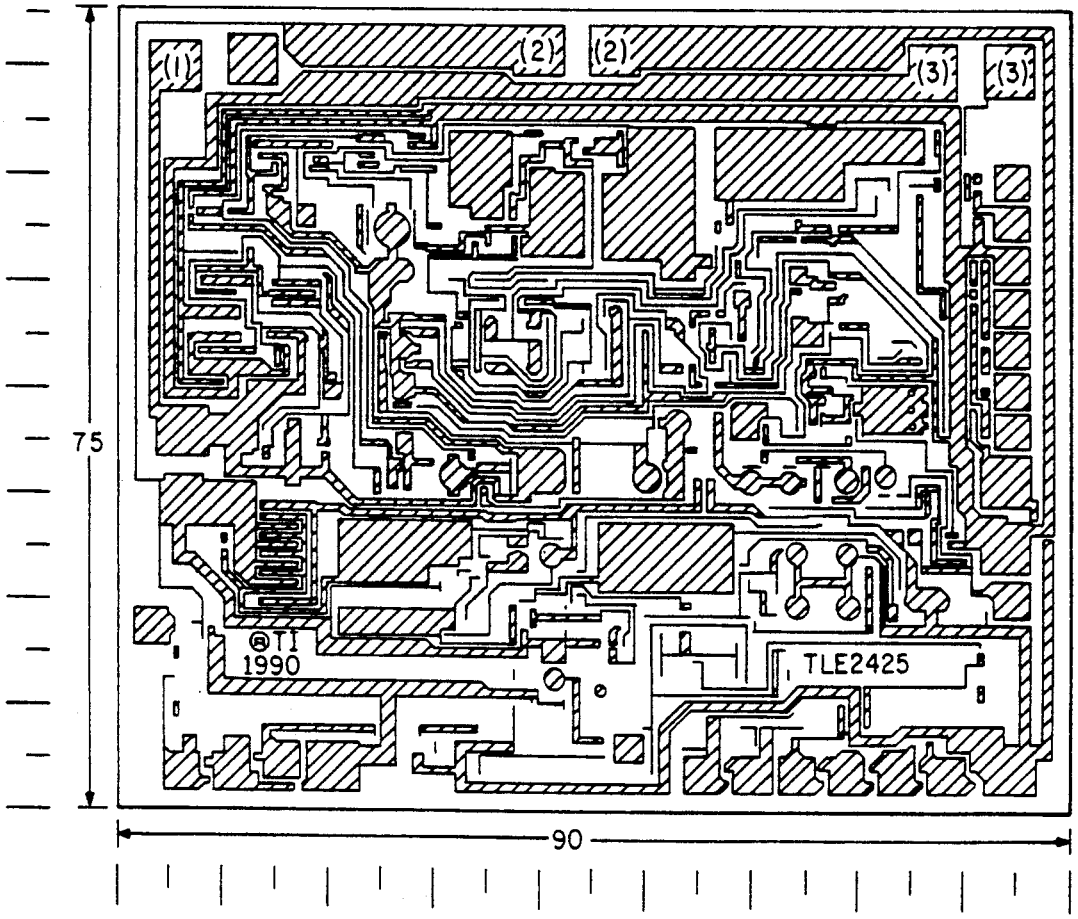
FIG. 7 depicts an integrated circuit implementing the circuit of FIG. 2.

FIG. 7 depicts an integrated circuit embodying the virtual ground circuit of FIG. 2. Note that the bond pads labeled (2) and (3) are the common and $V_o$ terminals, respectively. In order to improve the noise rejection and performance of the integrated circuit, the low and high current paths are separated, and the final connection of these paths is made with bond wires.

Note that the integrated circuit of FIG. 7 may be reconfigured using the programmable fuses shown in FIGS. 4 and 5. By use of the fuses in the bandgap reference schematic of FIG. 5, the bandgap circuitry can be disabled and the resistor divider comprised of R10 and R11 can be used to generate the reference voltage. This invention is disclosed fully in the cross-referenced application entitled "Rail Splitting Virtual Ground Generator for Single Supply Systems", U.S. patent application Ser. No. 758,039, filed Sep. 12, 1991. By use of the fuses shown in FIGS. 3 and 4, the fixed voltage virtual ground integrated circuit described herein can be reprogrammed to implement the rail splitting virtual ground circuit of the cross referenced application after the die has been processed. This feature advantageously allows a single integrated circuit to support two different virtual ground circuits without additional design and production costs.

Figure 8A:
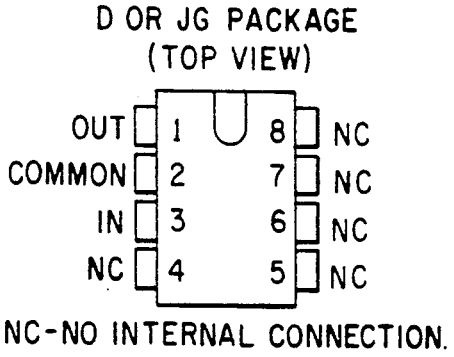
FIGS. 8*a* and 8*b* depict two embodiments of packaged integrated circuits implementing the circuit of FIG. 2.
Figure 8B:
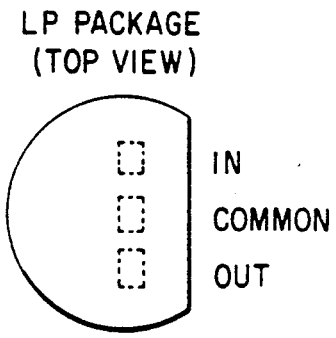

FIGS. 8A and 8B depict packaged dies of an integrated circuit embodying the invention depicted in FIG. 7. In FIG. 8A, the package depicted is a small area, three terminal package device particularly suited to applications where discrete components were used previously. This simple package allows easy upgrade of existing circuit board designs without new maskwork, the three terminal package is simply inserted so that the Vin terminal is at the supply voltage, the COM terminal is at ground or common, and the $V_o$ pin is at the virtual ground terminal. Circuit interconnection in the package is designed to minimize noise problems. Certain signals are connected by means of bond wires. This gives better load rejection.

FIG. 8B depicts an alternative package. Here, the integrated circuit die is packaged in an eight pin dual-in-line plastic package (DIP) as is well known in the art. Again, some of the connections are made using bond wires, to improve the noise rejection of the circuit. This package is appropriate for some applications where the DIP is preferred for its low profile and compatibility with other DIP packages.

A few preferred embodiments have been described in detail hereinabove. It is to be understood that the scope of the invention also comprehends embodiments different from those described, yet within the scope of the claims.

For example, color display devices can be raster-scanned cathode ray tubes or other raster-scanned devices; devices that are not raster-scanned and have parallel line or frame drives; color printers, film formatters, or other hard copy displays; liquid crystal, plasma, holographic, deformable micromirror, or other displays of non-CRT technology; or three-dimensional or other devices using nonplanar image formation technologies.

"Microcomputer" in some contexts is used to mean that microcomputer requires a memory and "microprocessor" does not. The usage herein is that these terms can also be synonymous and refer to equivalent things. The phrase "processing circuitry" comprehends ASICs (application specific integrated circuits), PAL (programmable array logic), PLAs (programmable logic arrays), decoders, memories, non-software based processors, or other circuitry, or digital computers including microprocessors and microcomputers of any architecture, or combinations thereof. Words of inclusion are to be interpreted as nonexhaustive in considering the scope of the invention.

Internal and external connections can be ohmic, capacitive, direct or indirect, via intervening circuits or otherwise. Implementation is contemplated in discrete components or fully integrated circuits in silicon, gallium arsenide, or other electronic materials families, as well as in optical-based or other technology-based forms and embodiments. It should be understood that various embodiments of the invention can employ or be embodied in hardware, software or microcoded firmware. Process diagrams are also representative of flow diagrams for microcoded and software based embodiments.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A fixed voltage virtual ground generator circuit, comprising:

a bias current source coupled to a first supply voltage;

a bandgap voltage reference circuit having an output coupled to a voltage reference node and further coupled between said bias current source and a second supply voltage;

an operational amplifier coupled to said voltage reference node in a unity gain configuration, having an output coupled to an output terminal, and powered by said bias current source and said second supply voltage;

operable to provide a stable fixed voltage at the output terminal over a wide range of supply voltage and temperature conditions.

2. The virtual ground generator circuit of claim 1, wherein said bandgap voltage reference circuit further comprises:

first and second resistors, coupled to said voltage reference node and further coupled to said second supply voltage, and further coupled to programmable fuses and resistances operable to enable programmation of said reference voltage to a precise, predetermined value.

3. The circuit of claim 1, wherein said bias current source further comprises transistors coupled for providing a reference current of a predetermined value, and further comprising transistors coupled as compensation circuitry, operable so that current variations with in the bias source due to ambient temperature variations do not change the reference current value.

4. The bias circuit of claim 3 wherein said compensation circuitry comprises JFET transistors.

5. The bias circuit of claim 3 wherein said compensation circuitry comprises isolated vertical bipolar transistors.

6. The circuit of claim 1, wherein said operational amplifier further comprises one differential input coupled to said reference voltage and a second differential input coupled to said voltage output.

7. The circuit of claim 1, wherein said operational amplifier further comprises an output stage coupled to said output terminal and further coupled to a boost stage, said boost stage operable to provide additional current sinking or sourcing capability when the current flowing through the output stage exceeds a predetermined threshold.

8. The operational amplifier of claim 7, wherein said output stage further comprises a sensing transistor coupled to said boost stage, and operable to turn on said boost stage when the current flowing through the conduction path of said sensing transistor exceeds a certain threshold.

9. The operational amplifier of claim 8, wherein said boost stage comprises a first and second bipolar transistor, each having its base coupled to said sensing transistor, and each having its conduction path coupled between said voltage output and one of said voltage supplies, operable to provide increased current flow through the conduction paths of said first or second transistor when the current flowing at the voltage output exceeds said predetermined threshold.

10. The operational amplifier of claim 7, wherein said output stage is coupled to a plurality of gain stages, coupled together and further coupled to said voltage reference node, operable to provide a large gain in signal amplitude from said voltage reference to said output stage.

11. The operational amplifier of claim 1, wherein said operational amplifier is comprised of isolated vertical bipolar transistors coupled to form a differential input stage, a plurality of gain stages coupled together and to the differential input stage, and an output stage coupled to said voltage output.

12. The circuit of claim 1, wherein said operational amplifier further comprises a plurality of resistors coupled with programmable fuses, operable to allow selective programmation of the offset voltage of said operational amplifier, to allow minimization said offset voltage.

13. A method for creating a virtual ground reference voltage for use in a single supply system, comprising the steps of:

providing a bandgap voltage reference circuit coupled to a voltage reference node;

providing a temperature stable bias current source coupled to said first voltage supply and to said bandgap voltage reference circuit;

providing an operational amplifier having increased current drive capability, powered by said bias current source and said second voltage supply;

coupling a said voltage reference node to a first input terminal of said operational amplifier;

coupling the output of said operational amplifier to a voltage output terminal, and further coupling said voltage output terminal to a second input terminal of said operation amplifier; and operating said operational amplifier in a unity gain configuration so as to provide a voltage at the voltage output terminal that is equal to the fixed voltage provided by the bandgap voltage reference circuit over a wide range of supply voltages and temperature conditions.

14. The method of claim 13, and further comprising the step of providing a precision voltage resistor divider coupled to said bandgap reference generator in a parallel fashion, and having programmable fuses operable to disable said bandgap reference generator and enable said voltage divider.

15. The method of claim 13, wherein said step of providing an operational amplifier comprises providing an operational amplifier fabricated from isolated vertical bipolar transistors.

16. The method of claim 15, wherein said step of providing an operational amplifier further comprises providing an operational amplifier having a boost circuit comprising a first and second isolated vertical bipolar transistor each having their conduction paths coupled between said output voltage terminal and one of said first and second voltage supplies.

17. An integrated circuit implementing a virtual ground reference voltage circuit, comprising:

first and second voltage supply terminals;

a voltage output terminal;

a bias current source coupled to said first supply voltage;

a bandgap reference circuit, coupled to a voltage reference node and further coupled between said first and second supply voltages, operable such that a predetermined reference voltage is available at the voltage reference node;

an operational amplifier coupled to said reference voltage node in a unity gain configuration, having an output coupled to said output terminal, and powered by said bias current source and said second supply voltage; and operable to provide a stable voltage at the output terminal which is equal to a predetermined value between said first and second supply voltages over a wide range of supply voltage and temperature conditions.

18. A fixed voltage generator circuit, comprising:

a bias current source coupled to a first supply voltage;

a bandgap reference circuit having an output coupled to a voltage reference node and further coupled to said bias current source and to a second supply voltage;

an operational amplifier in a unity gain configuration coupled to said voltage reference node, having its output coupled to an output terminal;

said operational amplifier having an output stage coupled to said output terminal and further coupled to a boost stage, said boost stage operable to provide additional current sinking or sourcing capability when the current flowing through the output stage exceeds a predetermined threshold; and operable to provide a stable fixed voltage at the output terminal.

19. The fixed voltage generator circuit of claim 18, wherein said fixed voltage at the output terminal is a voltage halfway between the first and second supply voltages.

20. The bandgap reference circuit of claim 18, wherein said bias current source comprises circuitry operable to provide a constant current of predetermined value over a range of temperature conditions.

21. The bandgap reference circuit of claim 20 wherein said bias current source further comprises transistors coupled as compensation circuitry operable such that current variations in the bias source due to ambient temperature variations do not change the constant current of predetermined value.

22. A fixed voltage generator circuit, comprising:

a bias current source coupled to a first supply voltage;

a differential amplifier in a unity gain configuration, coupled to a reference voltage, powered by said bias current source and having a voltage output;

a bandgap reference generator circuit coupled between said bias current source and a second supply voltage source, and providing said reference voltage at its output; and operable to provide a stable fixed voltage at the output of the differential amplifier.

23. The fixed voltage generator of claim 22, wherein said output voltage is halfway between said first and second supply voltages.

24. The fixed voltage generator of claim 23, wherein said differential amplifier is an operational amplifier.

25. The fixed voltage generator of claim 23, wherein said bandgap reference generator circuit comprises a resistive voltage divider coupled to a bandgap reference circuit.

26. The fixed voltage generator of claim 25, wherein said resistive voltage divider comprises resistors whose values may be altered after said circuit is produced to reduce errors.

27. A method for producing a stable fixed voltage output circuit, comprising the steps of:

providing a bias current source coupled to a first supply voltage;

providing a differential amplifier in a unity gain configuration and powered by said bias current source and having a voltage output terminal;

providing a voltage reference circuit coupled between said bias current source and a second supply voltage, and having an output; and coupling said voltage reference circuit to said differential amplifier and operating the circuit to produce a stable voltage at the voltage output terminal.

28. The method of claim 27, and further comprising the step of selecting the voltage reference at the output of said such that the voltage at the voltage output terminal is halfway between the first and second supply voltages.

29. A method for producing a stable fixed voltage output circuit, comprising the steps of:

providing a bias current source coupled to a first supply voltage;

providing a differential amplifier in a unity gain configuration and powered by said bias current source and having a voltage output terminal;

providing a voltage reference circuit coupled between said bias current source and a second supply voltage, and having an output;

coupling said voltage reference circuit to said differential amplifier and operating the circuit to produce a stable voltage at the voltage output terminal;

wherein said step of providing a bias current source comprises selecting a bias current circuit which has a stable output which remains constant over a wide range of temperature and voltage conditions.

* * * * *